US007504917B2

(12) United States Patent
Tsukada et al.

(10) Patent No.: US 7,504,917 B2
(45) Date of Patent: Mar. 17, 2009

(54) ELECTROMAGNETIC SWITCH OF STARTER

(75) Inventors: Mikio Tsukada, Toyoake (JP); Shinji Usami, Okazaki (JP)

(73) Assignee: Denso Corporation, Kariya (JP)

( * ) Notice: Subject to any disclaimer, the term of this patent is extended or adjusted under 35 U.S.C. 154(b) by 42 days.

(21) Appl. No.: 11/598,057

(22) Filed: Nov. 13, 2006

(65) Prior Publication Data

US 2007/0120632 A1 May 31, 2007

(30) Foreign Application Priority Data

Nov. 29, 2005 (JP) ..... 2005-344216

(51) Int. Cl.
*H01H 67/02* (2006.01)

(52) U.S. Cl. ..... 335/126; 335/131

(58) Field of Classification Search ..... 335/126, 335/131, 132, 278

See application file for complete search history.

(56) References Cited

U.S. PATENT DOCUMENTS

| | | | | |
|---|---|---|---|---|
| 2,268,718 | A * | 1/1942 | Newton | 338/8 |
| 2,332,139 | A * | 10/1943 | Finnegan | 335/217 |
| 3,171,064 | A | 2/1965 | Ruder | |
| 3,207,960 | A | 9/1965 | MacDougal | |
| 3,822,469 | A * | 7/1974 | Lazenby | 29/596 |
| 4,044,322 | A | 8/1977 | Brown et al. | |
| 5,014,027 | A * | 5/1991 | Ootsuka | 333/132 |
| 5,181,002 | A | 1/1993 | Sugiyama | |
| 5,252,935 | A | 10/1993 | Yamamoto et al. | |
| 5,338,996 | A * | 8/1994 | Yamamoto | 310/217 |
| 6,281,770 | B1 * | 8/2001 | Quentric | 335/126 |
| 6,578,689 | B2 * | 6/2003 | Kawada et al. | 192/84.961 |
| 6,798,323 | B2 * | 9/2004 | Smith et al. | 335/132 |
| 7,420,309 | B2 | 9/2008 | Wakitani et al. | |
| 2007/0013255 | A1 | 1/2007 | Wakitani et al. | |
| 2007/0188278 | A1 | 8/2007 | Tsukada et al. | |

FOREIGN PATENT DOCUMENTS

JP A 2002-524826 8/2002

OTHER PUBLICATIONS

U.S. Appl. No. 11/705,122 in the name of Tadahiro Kurasawa, filed Feb. 12, 2007.

* cited by examiner

*Primary Examiner*—Elvin G Enad
*Assistant Examiner*—Alexander Talpalatskiy
(74) *Attorney, Agent, or Firm*—Oliff & Berridge, PLC

(57) ABSTRACT

An electromagnetic switch has a magnetic core having a base member and a disc member. The disc member is made of plates laminated along a pulling direction and has an inner hole. The base member has both a first portion and a second portion having a groove on its outer surface and disposed in the hole. An inner portion of a particular plate among the plates is disposed in the groove so as to fasten the particular plate to the base member. When the core is magnetized in response to excitation of a coil, a plunger is moved toward the first portion of the core along the pulling direction, a movable contact moved with the plunger comes in contact with a fixed contact electrically connected with a motor, and electric power is supplied to the motor through the fixed and movable contacts.

4 Claims, 6 Drawing Sheets

ELECTROMAGNETIC SWITCH OF STARTER

CROSS-REFERENCE TO RELATED APPLICATION

This application is based upon and claims the benefit of priority of the prior Japanese Patent Application 2005-344216 filed on Nov. 29, 2005 so that the contents of which are incorporated herein by reference.

BACKGROUND OF THE INVENTION

1. Field of the Invention

The present invention relates to an electromagnetic switch of a starter which is turned on by using a magnetic attraction force to start driving an engine.

2. Description of Related Art

An electromagnetic switch of a starter has been used to start driving an engine of a vehicle. When a driver turns on an ignition switch, an electric current passes through an exciting coil of an electromagnetic switch, so that the exciting coil generates a magnetic field. A fixed magnetic core of the switch is magnetized by the magnetic field, and a plunger of the switch is pulled toward the magnetized core along an axial direction of the plunger. In response to the movement of the plunger, a movable contact of the switch is moved along the axial direction and comes in contact with fixed contacts. That is, the switch is turned on. Then, electric power is supplied to a motor through the fixed and movable contacts to drive the motor, and a rotary shaft is rotated on its axis by the motor. Further, in response to the movement of the plunger, the rotary shaft is mechanically connected with an engine, and a rotational force of the rotary shaft is transmitted to the engine. Therefore, an operation of the engine is started.

In a prior art, the magnetic core of the electromagnetic switch is integrally formed by performing extrusion for a metallic body. However, because the shape of the core is complicated, a manufacturing cost is undesirably increased. To reduce this cost, a technique has been proposed that a base member and a disc member are separately produced and are assembled into the core. In this technique, the base member having a simple structure is produced by performing extrusion, lathe turning or centering for a metallic body, and the disc member is produced by stamping a thin metallic plate in a pressing process. To preferably lead a movable contact moved by the magnetic core into a center hole of the disc member, it is required to thicken the disc member.

However, because the disc member is produced by performing a drawing press for a thin metallic plate, it is difficult to efficiently produce the disc member, and a powerful pressing machine is required to produce the disc member. To solve this problem, Japanese Translation of PCT No. 2002-524826 discloses a technique that a disc member is made by laminating a plurality of thin metallic plates. In this technique, a base member is forcibly inserted into a center opening of each metallic plate so as to assemble the disc member and the base member held each other into a magnetic core. Therefore, a magnetic core can be obtained at low cost.

However, in this magnetic core, the center openings of the thin metallic plates have easily various sizes. Further, because the opening of each plate is formed by shearing the plate in a pressing process, sheared surfaces of the plates easily form a non-flat surface surrounding a center hole of the disc member. In this case, a holding load added to each plate differs from those of the other plates. Moreover, because a plunger collides with the base member each time the electromagnetic switch is turned on, distortion is frequently generated in the disc member repeatedly receiving a pushing force from the plunger through the base member. Therefore, there is a high probability that the base member is detached from the disc member.

In addition, rigidity of a disc member is generally changed in proportional to both a third power of a thickness of each laminated thin plate and the number of plates forming the disc member. Therefore, rigidity of the disc member formed of a lamination body of thin plates becomes lower than that formed of a single plate which has the same thickness as that of the lamination body. Therefore, because the plunger collides with the base member each time a movable contact of the electromagnetic switch comes in contact with fixed contacts of the electromagnetic switch in response to the turn-on of the electromagnetic switch, there is high probability that the whole disc member having low rigidity is bent or warped due to the repeated collision of the plunger with the base member. In this case, contact of the movable contact with the fixed contacts becomes undesirably unstable.

SUMMARY OF THE INVENTION

An object of the present invention is to provide, with due consideration to the drawbacks of the conventional electromagnetic switch, an electromagnetic switch wherein a base member reliably holds a disc member formed of a lamination of a plurality of thin metallic plates while preventing the disc member from being bent or warped due to an external force and preventing the base member from being detached from the disc member.

According to an aspect of this invention, the object is achieved by the provision of an electromagnetic switch of a starter comprising an exciting coil, a magnetic core, a plunger, and a switch member. The magnetic core has a base member and a disc member. The base member has a first base portion and a second base portion extending from a first side surface of the first base portion along a pulling direction. The second base portion has a concavity on its outer surface. The disc member is made of a plurality of plates laminated along the pulling direction and has an inner hole facing an inner surface of each plate. The second base portion of the base member is disposed in the hole of the disc member, and an inner portion of a particular plate among the plates is disposed in the concavity of the second base portion so as to fasten the particular plate to the base member.

When receiving an electric current, the coil generates a magnetic field, and the core is magnetized by the magnetic field. The plunger is pulled toward the magnetic core along a pulling direction in response to the magnetization of the core, and the switch member is turned on in response to the plunger pulled toward the magnetic core. Therefore, electric power is supplied to a motor, and an operation of the motor is started to start driving an engine.

When the plunger is pulled toward the magnetic core the plunger collides with a second side surface of the first base portion opposite to the first side surface of the first base portion and gives an external force to the disc member through the base member. In this case, there is a possibility that the disc member is bent or warped or the base member is detached from the disc member. However, because the inner portion of the particular plate is disposed in the concavity of the second base portion so as to fasten the particular plate to the base member, the base member reliably holds the disc member against the collision of the plunger with the base member. Accordingly, the particular plate fastened to the base member can prevent the disc member from being bent or warped due to an external force and prevent the base member from being detached from the disc member.

DETAILED DESCRIPTION OF THE PREFERRED EMBODIMENTS

Embodiments of the present invention will now be described with reference to the accompanying drawings. However, these embodiments should not be construed as limiting the present invention to structures of those embodiments, and the structure of this invention may be combined with that based on the prior art.

Embodiment 1

Figure 1:
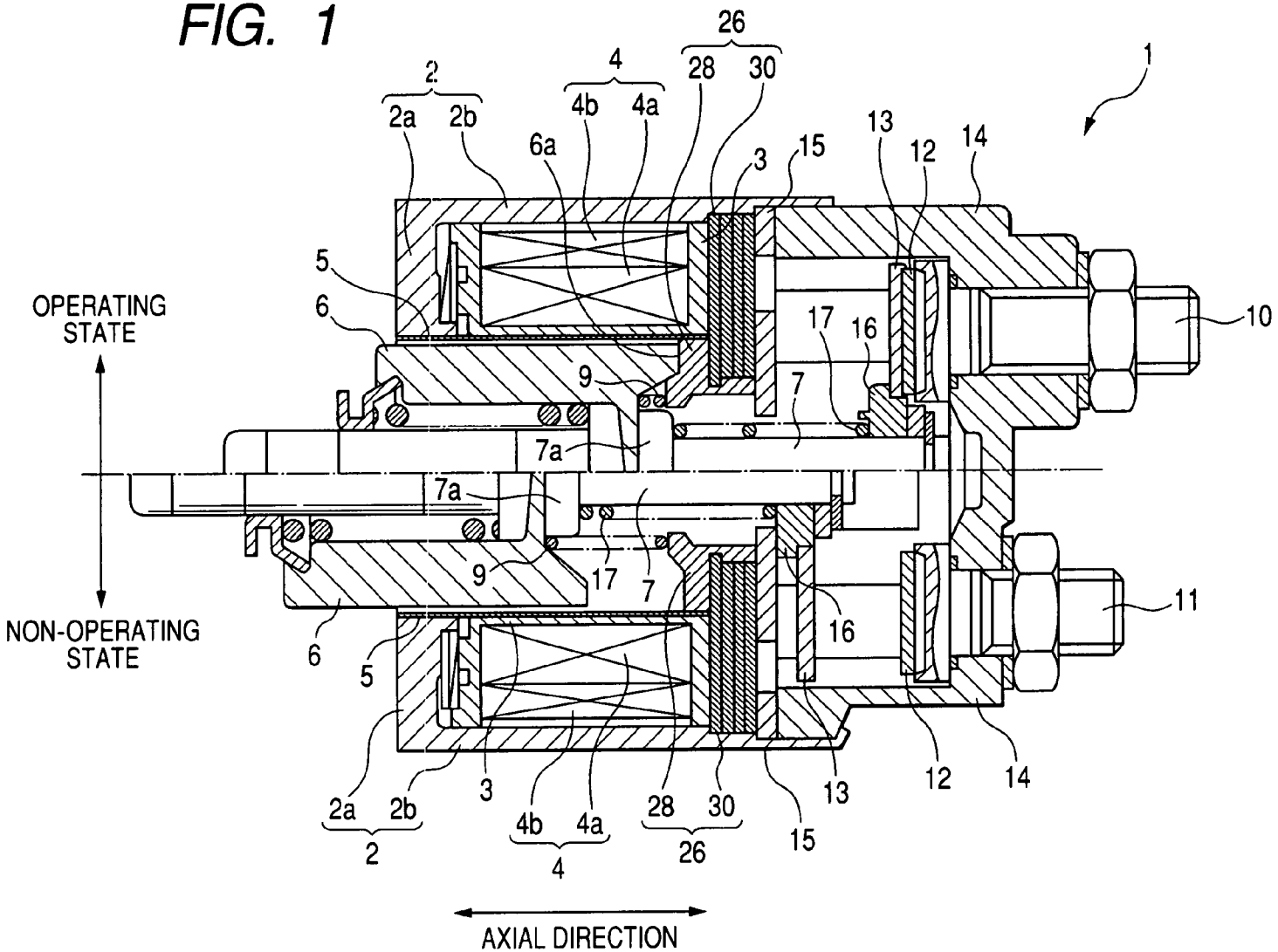
FIG. 1 is a sectional view of an electromagnetic switch of a starter according to embodiments of the present invention.

FIG. 1 is a sectional view of an electromagnetic switch of a starter according to embodiments of the present invention. An upper half portion in FIG. 1 illustrates an electromagnetic switch set at an operating state (i.e., turned-on state), and a lower half portion in FIG. 1 illustrates an electromagnetic switch set at a non-operating state (i.e., turned-off state).

An electromagnetic switch is installed in a starter (not shown) used for starting an operation of an engine of a vehicle. As shown in FIG. 1, an electromagnetic switch 1 comprises an exciting coil 4 which receives an electric current and generates a magnetic field from the electric current, a fixed magnetic core 26 which is magnetized by the magnetic field, a plunger 6 which is pulled toward the core 26 along an axial (or pulling) direction of the switch 1 in response to the magnetization of the magnetic core, a fixed contact 12 which is electrically connected with an energizing circuit of a motor (not shown), another fixed contact 12 which is electrically connected with a terminal of an onboard battery (not shown), and a movable contact 13 which is moved with the plunger 6 so as to come in contact with the fixed contacts 12. When the contact 13 come in contact with the fixed contacts 12, electric power is supplied to the energizing circuit of the motor through the contacts 12 and 13.

The switch 1 may further comprises a switch yoke 2 formed in a cup shape to accommodate the coil 4, a bobbin 3 on which the coil 4 is wound, a sleeve 5 disposed on an inner circumferential surface of the bobbin 3, a shaft 7 fixed to a front end of the plunger 6 in the axial direction, a terminal bolt 10 through which the corresponding fixed contact 12 is electrically connected with a battery of a vehicle (not shown), a terminal bolt 11 through which the corresponding fixed contact 12 is electrically connected with the energizing circuit of the motor, a contact cover 14 to which the bolts 10 and 11 are fixed, a rubber packing 15 disposed between the cover 14 and core 26, and an insulating element 16 attached to a front end of the shaft 7 and mounting the movable contact 13 to insulate the movable contact 13 from the shaft 7.

The core 26 is disposed adjacent to the coil 4 through the bobbin 3 on an open side of the yoke 2 in the axial direction so as to surround the coil 4 with the yoke 2. The yoke 2 has a bottom wall 2*a* and an outer wall 2*b* extending from the periphery of the wall 2*a* along the axial direction in a cylindrical shape to cover the coil 4. The wall 2*a* has a circular hole at the center of the yoke 2. The yoke 2 acts as an outer frame of the switch 1 and forms a magnetic circuit around the coil 4 in cooperation with the core 26.

The coil 4 has both a pulling coil 4*a* and a holding coil 4*b* which are wound around the bobbin 3 in two layers. When receiving an electric current, the coils 4*a* and 4*b* generate a magnetic force in response to the electric current so as to magnetize the yoke 2 and the core 26. The sleeve 5 is made of stainless steel formed in a cylindrical shape and is disposed along both the inner circumferential surface of the bobbin 3 and the inner circumferential surface of the wall 2*a*.

The plunger 6 is inserted into an inner space of the sleeve 5 so as to extend along the axial direction. The plunger 6 is movable along the axial direction while using the inner circumferential surface of the sleeve 5 as a guide surface. The plunger 6 has a concave surface 6*a* formed in a trapezoid shape at the front end of the plunger 6. When the core 26 is magnetized, the plunger 6 is pulled toward the core 26 along the axial direction, and the plunger 6 engages with the core 26 so as to make the surface 6*a* come in contact with a surface of the core 26 without forming any open space between the surfaces.

The shaft 7 has a flange 7*a* on its one end, and the flange 7*a* is fixed to the front end of the plunger 6 by welding. The movable contact 13 is fixed to a front end of the shaft 7 opposite to the plunger 6 in the axial direction. Therefore, the shaft 7 and contact 13 are moved with the plunger 6. The contacts 12 are disposed in the inside of the cover 14. The cover 14 is made of resin and is fixed to the end of the wall 2*b* of the yoke 2 by caulking. Therefore, the core 26 is fixedly placed between the coil 4 accommodated in the yoke 2 and the packing 15 pushed by the cover 14. A return spring 9 is disposed between the plunger 6 and the core 26 so as to forcibly push the plunger 6 toward a non-core side of the axial direction (i.e., left side in FIG. 1). A contact spring 17 is disposed between the flange 7*a* of the shaft 7 and the element 16 to fixedly place the contact 13 at the front end of the shaft 7.

An operation of the switch 1 is briefly described. When an ignition key (not shown) is entered into a key receiver or a starting button is switch on, an electric current is supplied from an onboard battery to the coil 4 to generate a magnetic field in the coil 4. The core 26 is magnetized in response to the magnetic field, and a magnetic attraction force is generated between the core 26 and the plunger 6. In response to the magnetic attraction force, the plunger 6 is moved toward the core 26 while compressing the spring 9 so as to accumulate a resilient force in the spring 9, and the movable contact 13 is moved with the plunger 6 along the axial direction. Finally, as shown in the upper half portion of FIG. 1, the movable contact 13 comes in contact with the fixed contacts 12, and the surface 6*a* of the plunger 6 collides with the core 26 so as to stop the movement of the plunger 6. Therefore, electric power is supplied from a battery (not shown) to the energizing circuit of the motor through the fixed and movable contacts 12 and 13 and the bolts 10 and 11, and the motor is operated so as to rotate an output shaft mechanism (not shown). Further, in response to the movement of the plunger 6, the mechanism is mechanically connected with an engine, and a rotational force of the mechanism is transmitted to the engine. Therefore, an operation of the engine is started.

After the operation of the engine is started, the supply of the electric current to the coil 4 is stopped, the magnetic attraction of the core 26 disappears, and the plunger 6 is pushed back toward the non-core side by a reaction force of the spring 9. Finally, as shown in the lower half portion of FIG. 1, the movable contact 13 is detached from the fixed contacts 12. Therefore, no electric power is supplied to the energizing circuit of the motor, and the operation of the motor is stopped.

Figure 2:
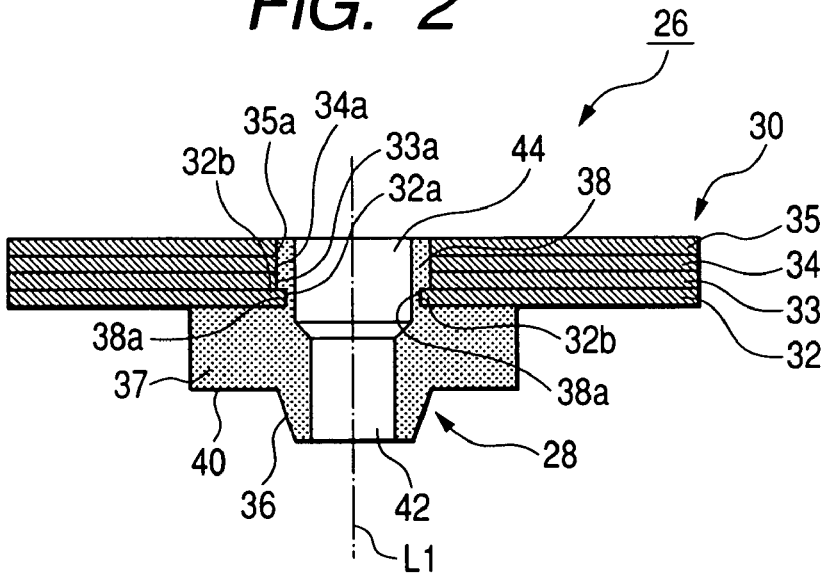
FIG. 2 is a sectional view of a core shown in FIG. 1 according to the first embodiment.

Next, the arrangement of the core 26 is described in detail with reference to FIG. 2. FIG. 2 is a sectional view of the core 26 according to the first embodiment.

As shown in FIG. 2, the core 26 is formed to be symmetric with respect to a center axis L1 extending along the axial direction. The core 26 has both a base member 28 and a disc member 30 supported by the packing 15.

The base member 28 is formed almost in a cylindrical shape. A through hole 42 extending along the axial direction is formed at a center space of the base member 28. The shaft 7 and spring 9 are moved in the hole 42 along the axial direction. The member 28 has a head portion 36 formed in a trapezoid shape, a body portion 37, and a tail portion 38 formed in a cylindrical shape along the axial direction. The body portion 37 has an outer diameter larger than an outer diameter of the tail portion 38. A shoulder surface 40 is formed by surfaces of the portions 36 and 37 placed opposite to the disc member 30 and faces the plunger 6. When the plunger 6 is moved toward the core 26, the surface 40 comes in contact with the surface 6*a* of the plunger 6, and the core 26 engages with the plunger 6.

The tail portion 38 has a concavity (or notch) 38*a* on its outer surface. The concavity 38*a* is, for example, placed at an end of the portion 38 adjacent to the body portion 37. The concavity 38*a* is preferably formed as a groove extending in a ring shape so as to surround the hole 42 around the center axis L1. A width of the groove 38*a* is slightly wider than a thickness of a thin plate forming the disc member 30 so as to fit the thin plate into the member 30.

The disc member 30 is formed in a cylindrical shape and has fourth in metallic plates 32, 33, 34 and 35 laminated in that order along the axial direction. Each plate has a circular opening which faces an inner surface 32*a*, 33*a*, 34*a* or 35*a* of the plate. The openings of the plates 32 to 35 form a through hole 44 of the member 30. The hole 44 has a diameter almost equal to the outer diameter of the tail portion 38, and the members 28 and 30 are assembled into the core 26 so as to place the tail portion 38 in the hole 44. The plate 35 is placed furthest from the body portion 37, and the plate 32 is placed adjacent to the body portion 37. The lamination of the plates 32 to 35 has a thickness equal to a length of the tail portion 38 along the axial direction, so that an end surface of the tail portion 38 and a surface of the plate 35 form a flat surface facing the packing 15. The opening formed in the plate 32 has a diameter smaller than those of the openings of the other plates 33 to 35. When the members 28 and 30 are assembled into the core 26, an inner portion 32*b* of the plate 32 is inserted into the groove 38*a* of the tail portion 38 so as to fit the plate 32 to the tail portion 38, and the disc member 30 is fastened to the base member 28.

Figure 3:
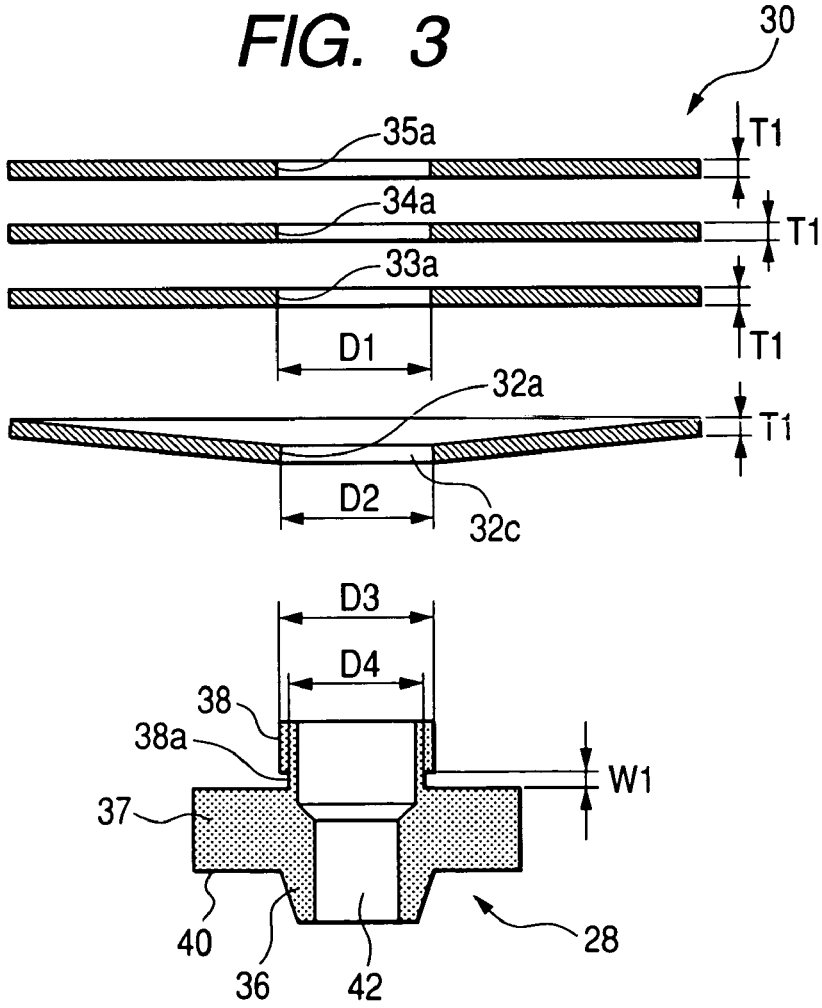
FIG. 3 is a sectional view of both a base member and a disc member not yet assembled into a core according to the first embodiment.
Figure 4A:
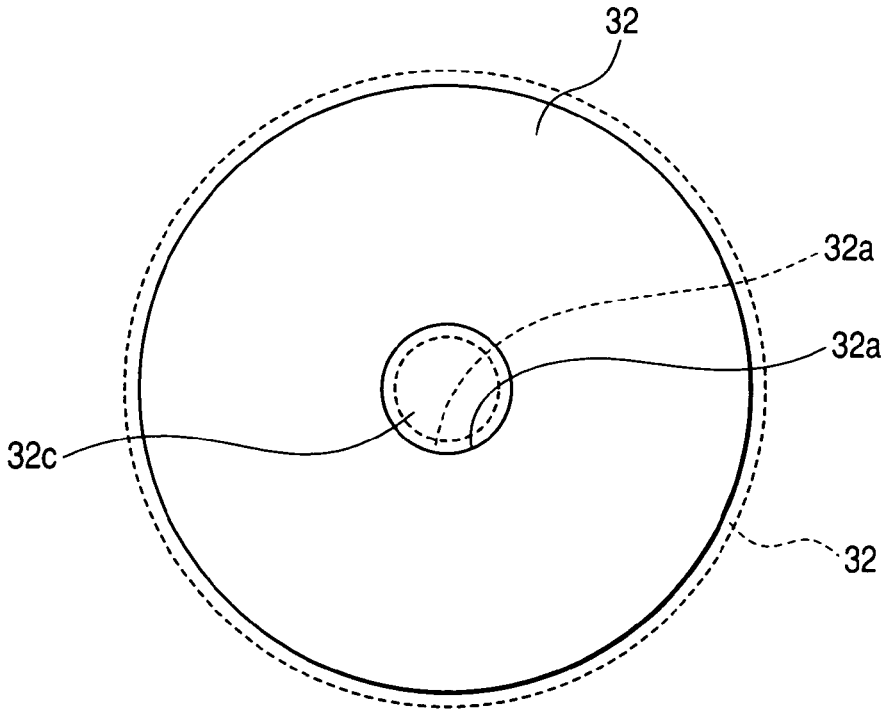
FIG. 4A is a plan view of a particular plate of the disc member.
Figure 4B:
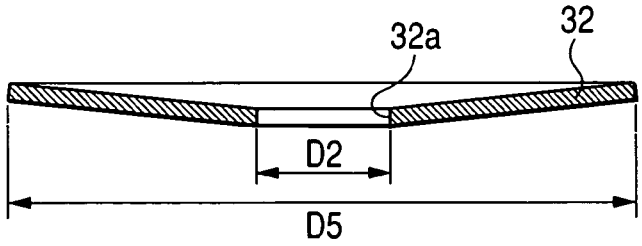
FIG. 4B is a sectional view of the particular plate not yet fitted to the base member.
Figure 4C:
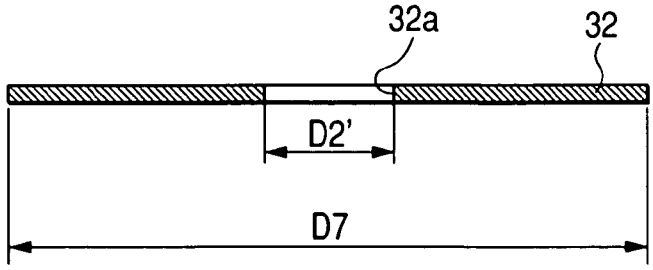
FIG. 4C is a sectional view of the particular plate deformed when being fitted to the base member.
Figure 5A:
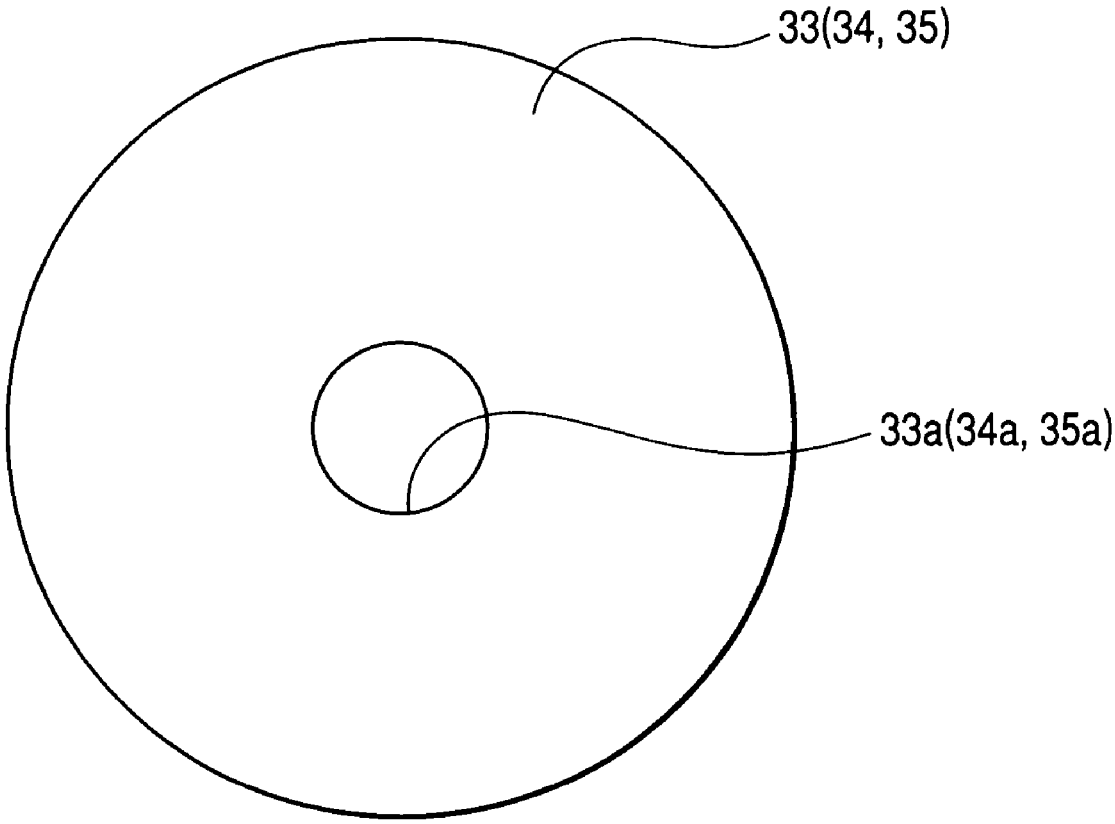
FIG. 5A is a plan view of other plates forming the disc member.
Figure 5B:
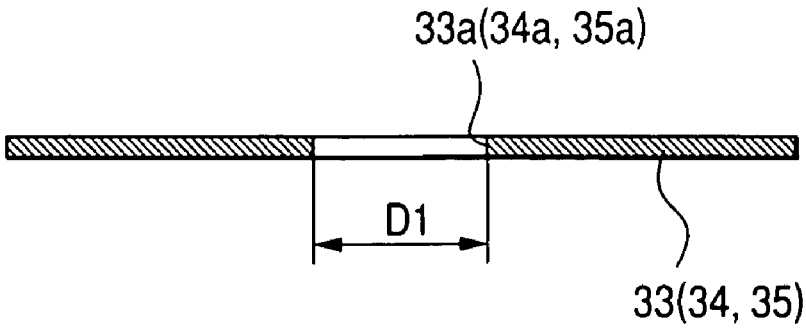
FIG. 5B is a sectional view of the plates shown in FIG. 5A.

The shape and size of the plates 32 to 35 of the disc member 30 and the size of the tail portion 38 of the base member 28 are described. FIG. 3 is a sectional view of both the base member 28 and the disc member 30 not yet assembled into the core 26 according to the first embodiment. FIG. 4A is a plan view of the plate 32, FIG. 4B is a sectional view of the plate 32 not yet fitted to the base member 28, and FIG. 4C is a sectional view of the plate 32 deformed when being fitted to the base member 28. FIG. 5A is a plan view of the plates 33 to 35, and FIG. 5B is a sectional view of the plates 33 to 35. In FIG. 4A, the plate 32 not yet fitted to the member 28 is indicated by solid lines, and the plate 32 fitted to the member 28 is indicated by dotted lines.

As shown in FIG. 3, FIG. 4A and FIG. 4B, the plate 32 is formed in a shape of a coned disc spring and has a circular shape when being seen along the axial direction. The plate 32 has a circular opening 32*c* surrounded by the inner surface 32*a* in its center area. The plate 32 is formed to be warped such that an inner portion of the plate 32 is risen from a peripheral portion of the plate 32. As shown in FIG. 3, FIG. 5A and FIG. 5B, the other plates 33 to 35 are formed in the same flat circular shape as one another. Each of the plates 33 to 35 has a circular opening surrounded by the inner surface 33*a*, 34*a* or 35*a* in its center area.

An inner diameter D1 (i.e., diameter of opening) of the plates 33 to 35 is set to be almost equal to an outer diameter D3 of the tail portion 38 at a position other than the groove 38*a* (D1≈D3). The plate 32 not yet fitted to the base member 28 has an inner diameter D2 (i.e., diameter of opening), and the diameter D2 is set to be equal to or slightly larger than the diameter D3 (D2≧D3). An outer diameter D4 of the tail portion 38 at the groove 38*a* is set to be smaller than the diameter D3 (D4<D3). An outer diameter D5 of the plate 32 not yet fitted to the base member 28 is smaller than an outer diameter D6 of the plates 33 to 35. The plates 32 to 35 have the same thickness T1 as one another, and the thickness T1 is slightly smaller than a width W1 of the groove 38*a*.

Next, the assembling of the members 28 and 30 into the core 26 is described.

As shown in FIG. 3, the plate 32 is disposed such that the inner surface 32*a* of the plate 32 is protruded toward the tail portion 38 of the base member 28, and the portion 38 is inserted into the opening 32*c* of the plate 32. Because of the relation D2≧D3, the plate 32 can smoothly reach the groove 38*a*, and an inner portion of the plate 32 comes in contact with a flattened surface 37*a* of the body portion 37 opposite to the surface 40 along the axial direction. Then, an external force is added to the plate 32 placed on the body portion 37 such that the plate 32 is pressed against the body portion 37. In response to this force, the warped plate 32 is deformed into a flattened plate. In this deformation, as shown in FIG. 4C, because the diameter D2 of the plate 32 becomes smaller, the inner portion 32*b* of the plate 32 is inserted into the groove 38*a* and is fitted to the tail portion 38. Therefore, as shown in FIG. 2, the inner portion 32*b* of the plate 32 is disposed in the groove 38*a*, a flattened surface of the plate 32 comes in contact with the surface 37*a* of the body portion 37 without forming any open space, and the plate 32 is fastened to the base member 28. In this case, the plate 32 has an inner diameter D2' smaller than the diameter D3 (D2'<D3) and substantially equal to the diameter D4 (D2'≈D4). Further, the outer diameter D5 of the plate 32 becomes larger, and the plate 32 has an outer diameter D7 substantially equal to the outer diameter D6 of the plates 33 to 35 (D7=D6).

After the plate 32 is fitted to the base member 28, the tail portion 38 of the base member 28 is forcibly inserted into the opening of each of the plates 33 to 35 such that the plates 32 to 35 are laminated. Because of the relation D1≈D3, the plates 33 to 35 are fixed to the base member 28.

Accordingly, because the inner portion 32*b* of the plate 32 of the disc member 30 is fitted to the tail portion 38 of the base member 28 so as to fasten the plate 32 to the base member 28, the disc member 30 can be reliably held by the base member 28. That is, even though the plunger 6 pulled toward the core 26 collides with the base member 28, the plate 32 fitted to the tail portion 38 prevents the disc member 30 from being shifted along the axial direction. Therefore, even though the disc member 30 repeatedly receives a pushing force from the plunger 6 through the base member 28, the plate 32 can prevent the base member 28 from being detached from the disc member 30.

Further, because the plate 32 is fitted to the base member 28 so as to fasten the disc member 30 to the base member 28, the disc member 30 formed of the plates 32 to 35 is hardly bent or warped due to the repeated collision of the plunger 6 with the base member 28. Accordingly, contact of the movable contact 13 with the fixed contacts 12 can be reliably maintained.

Moreover, because the inner portion of the plate 32 is fitted into the groove 32*a* without substantially forming an opening between the plate 32 and the tail portion 38 due to the relation D2'≈D4, a magnetic coupling between the plate 32 and the tail portion 38 can be reliably obtained. Accordingly, a magnetic field can be sufficiently formed in the core 26 in response to an electric current supplied to the coil 4 so as to move the plunger 6.

Furthermore, even though the openings of the plates 33 to 35 are formed so as to lower a holding load of the base member 28 on the plates 33 to 35, the disc member 30 can be reliably held by the base member 28 due to the plate 32 fitted to the base member 28. Accordingly, the disc member 30 can be produced at high productivity.

Still further, because the plate 32 formed in a shape of a coned disc spring is deformed into a flattened plate, the plate 32 deformed in a flattened shape and the plates 33 to 35 formed in a flattened shape can be laminated without forming an opening between the adjacent plates. Further, because the plate 32 formed in a shape of a coned disc spring is merely inserted into the groove 38*a* and is fitted to the base member 28 to fasten the disc member 30 to the base member 28, a fitting and fastening structure in the core 26 can be simplified. Moreover, because the plate 32 placed on the body portion 37 is merely pressed against the body portion 37 so as to insert the inner portion 32*b* of the plate 32 into the opening 38*a*, the plate 32 can be easily fitted to the tail portion 38 in a short time by using a hydraulic pressing machine having low power. Accordingly, a manufacturing cost of the core 26 can be reduced.

In this embodiment, the plates 32 to 35 has the same thickness. However, the thickness of each plate may differ from those of the other plates.

Embodiment 2

In the first embodiment, the plate 32 nearest to the base portion 37 among the plates 32 to 35 is formed in a shape of a coned disc spring and is fitted to the tail portion 38. However, any of the plates 32 to 35 may be formed in a shape of a coned disc spring and be fitted to the tail portion 38.

Figure 6A:
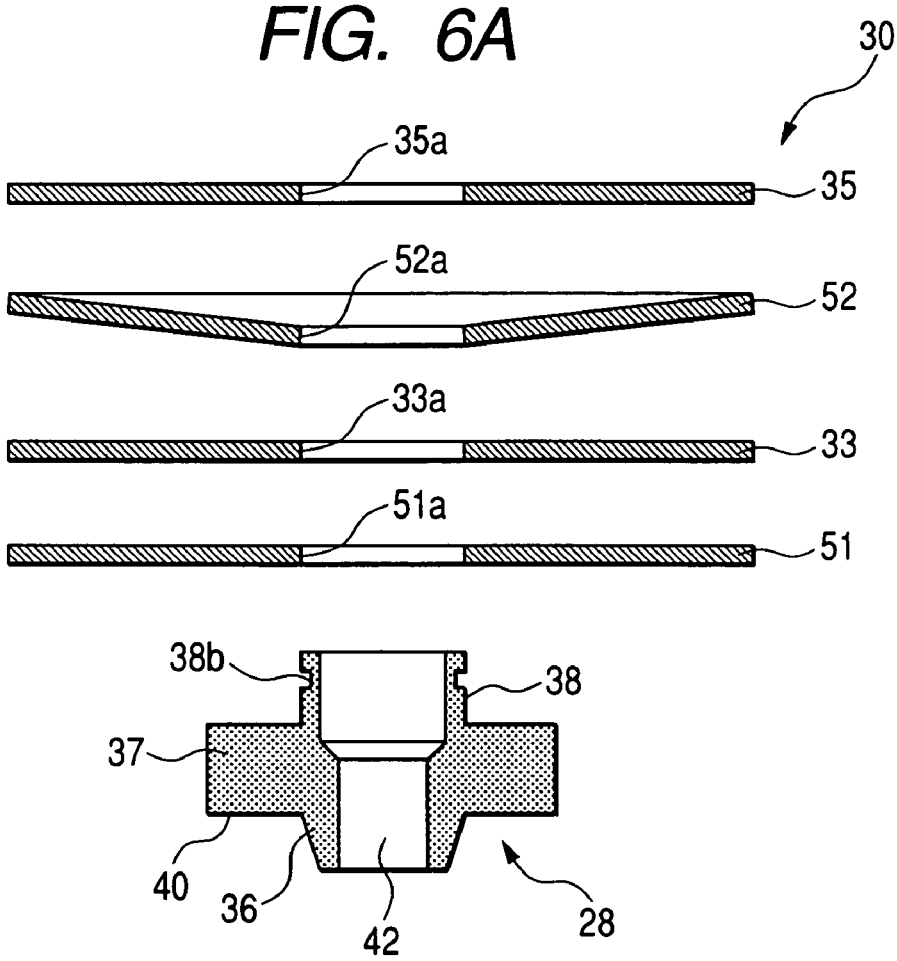
FIG. 6A is a sectional view of both a base member and a disc member not yet assembled into a core according to the second embodiment.
Figure 6B:
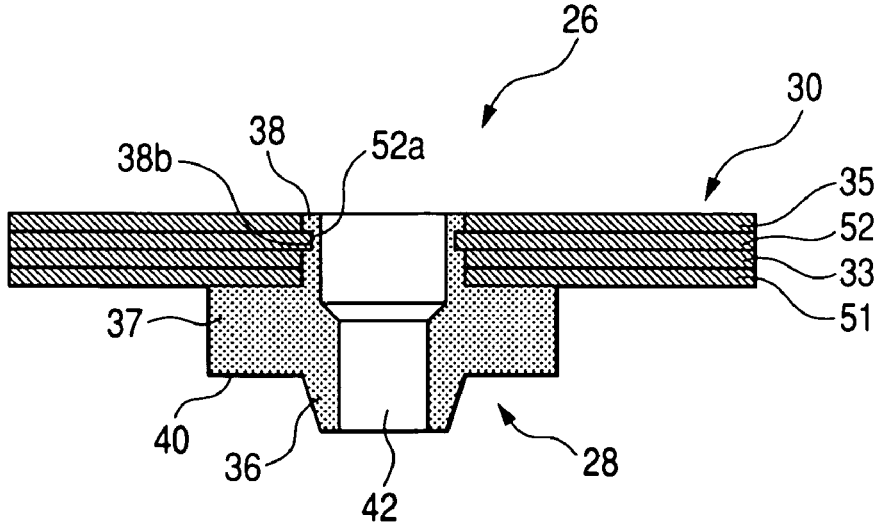
FIG. 6B is a sectional view of both the base member and the disc member assembled into a magnetic core according to the second embodiment.

FIG. 6A is a sectional view of both the base member 28 and the disc member 30 not yet assembled into the core 26 according to the second embodiment, and FIG. 6B is a sectional view of both the base member 28 and the disc member 30 assembled into the core 26 according to the second embodiment.

As shown in FIG. 6A and FIG. 6B, a thin metallic plate 51 is formed in a flat circular shape in the same manner as the plates 33 to 35, and a thin metallic plate 52 is formed in a shape of a coned disc spring in the same manner as the plate 32. The plates 51, 33, 52 and 35 are disposed in that order as the disc member 30, and the set of plates 51, 33, 52 and 35 and the base member 28 are assembled into the core 26 such that the plate 51 is directly in contact with the base portion 37. The tail portion 34 has a concavity 38*b* such as a groove, in place of the groove 38*a*. The groove 38*b* is formed on an outer surface of the tail portion 34 such that the groove 38*b* receives an inner portion of the plate 52.

Because the plate 52 is inserted into the groove 38*b* and is fitted to the tail portion 34 to fasten the plate 52 to the base member 28, the disc member 30 can be reliably held by the base member 28 so as not to be shifted along the axial direction. Accordingly, the plate 52 fitted to the base member 28 can prevent the base member 28 from being detached from the disc member 30.

Embodiment 3

In the first and second embodiments, only one of the plates forming the disc member 30 is formed in a shape of a coned disc spring and is inserted into a groove of the tail portion 38. However, the number of plates formed in a shape of a coned disc spring and inserted into a groove of the tail portion 38 may be arbitrarily set.

Figure 7A:
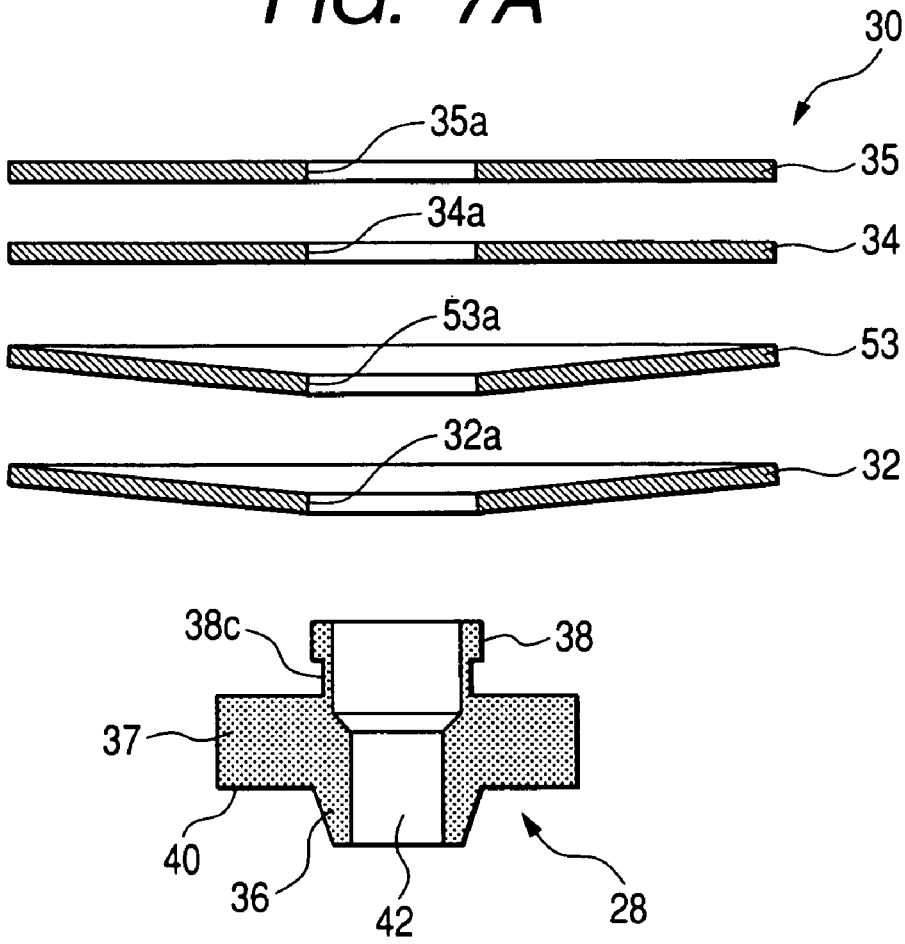
FIG. 7A is a sectional view of both a base member and a disc member not yet assembled into a core according to the third embodiment.
Figure 7B:
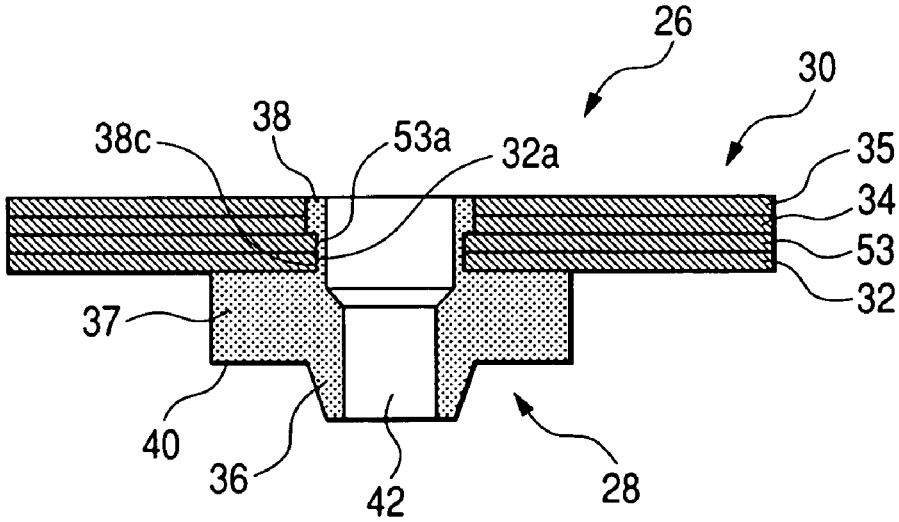
FIG. 7B is a sectional view of both the base member and the disc member assembled into a magnetic core according to the third embodiment.

FIG. 7A is a sectional view of both the base member 28 and the disc member 30 not yet assembled into the core 26 according to the third embodiment, and FIG. 7B is a sectional view of both the base member 28 and the disc member 30 assembled into the core 26 according to the third embodiment.

As shown in FIG. 7A and FIG. 7B, a thin metallic plate 53 is formed in a shape of a coned disc spring in the same manner as the plate 32. The plates 32, 53, 34 and 35 are disposed in that order as the disc member 30, and the set of plates 32, 53, 34 and 35 and the base member 28 are assembled into the core 26 such that the plate 32 is directly in contact with the base portion 37. The tail portion 34 has a concavity 38*c* such as a groove, in place of the groove 38*a* or 38*b*. The groove 38*c* is formed on an outer surface of the tail portion 34 such that the groove 38*c* receives inner portions of the plates 32 and 53.

Because the plates 32 and 53 are fitted into the groove 38*c* of the tail portion 34 to fasten the plates 32 and 53 to the base member 28, the disc member 30 can be reliably held by the base member 28 so as not to be shifted along the axial direction. Accordingly, the plates 32 and 53 fitted to the base member 28 can prevent the base member 28 from being detached from the disc member 30.

MODIFICATION

In the first to third embodiments, at least one of the plates forming the disc member 30 is formed in a shape of a coned disc spring and is fitted to the tail portion 38 while being deformed in a flattened shape. However, the present invention is not limited to the deformation of a warped plate into a flattened plate. For example, a thin metallic plate forming the disc member 30 with other plates may be formed in a flat circular shape having a circular opening at its center area such that an inner diameter of the plate is substantially equal to the diameter D4 at an ordinary temperature. This plate is heated to increase its inner diameter to a value substantially equal to the diameter D3 according to the thermal expansion of the plate. Then, the tail portion 38 of the base member 28 is inserted into the enlarged opening of the heated plate so as to place the plate on the groove 38*a* of the tail portion 38, and the heated plate is cooled to the ordinary temperature so as to be fitted to the tail portion 38.

Because the opening of the plate becomes larger and smaller according to the thermal expansion, the plate having the opening set at the diameter smaller than the outer diameter D3 of the tail portion 38 can be inserted into the groove 38*a* of the tail portion 38 to fasten the disc member 30 including the plate to the base member 28. Accordingly, even though all plates forming the disc member 30 are formed in a flat shape, the plate fitted to the base member 28 can prevent the base member 28 from being detached from the disc member 30.

What is claimed is:

1. An electromagnetic switch of a starter, comprising:

an exciting coil which receives an electric current and generates a magnetic field from the electric current;

a magnetic core which is magnetized by the magnetic field;

a plunger which is pulled toward the magnetic core along a pulling direction in response to the magnetization of the magnetic core; and a switch member which is turned on in response to the plunger pulled toward the magnetic core to supply electric power to a motor;

wherein the magnetic core comprises:

a base member having a first base portion and a second base portion extending from a first side surface of the first base portion along the pulling direction, the plunger coming in contact with a second side surface of the first base portion opposite to the first side surface of the first base portion; and a disc member which is made of a plurality of plates laminated along the pulling direction, each plate having an opening facing an inner surface of the each plate, the second base portion of the base member being disposed in an opening of the each plate so as to contact the plate;

wherein the second base portion has a groove on its outer surface that surrounds an opening of a particular plate of the plurality of plates, a size of the opening surrounded by the particular plate being smaller than openings surrounded by other of plurality of plates, wherein an inner portion of the particular plate is disposed in the groove of the second base portion so as to fasten the particular plate to the base member and fix the other plates to the second base portion of the base member, and wherein the particular plate of the disc member is formed and warped in a shape of a coned disc spring before being disposed in the groove of the second base portion, and is deformed into a flattened shape so as to be laminated with the other plates to be fastened to the base member.

2. The electromagnetic switch according to claim 1, wherein a size of the groove of the base member and a size of the inner portion of the particular plate of the disc member are set so as to obtain a magnetic coupling between the particular plate and the second base portion of the base member.

3. The electromagnetic switch according to claim 1, wherein inner portions of a plurality of particular plates among the plates are disposed in the groove of the second base portion so as to fasten the particular plates to the base member, while another plate or the other plates are fixed to the second base portion of the base member.

4. The electromagnetic switch according to claim 1, wherein the particular plate of the disc member is formed in a flattened shape so as to be laminated with the plurality of plates other than the particular plate, a depth of the groove of the base member is substantially equal to a change in size of the opening surrounded by the inner surface of the particular plate, and the change of the opening is caused by thermal expansion of the particular plate.

* * * * *